US006607412B2

(12) United States Patent
Mueller et al.

(10) Patent No.: US 6,607,412 B2
(45) Date of Patent: Aug. 19, 2003

(54) ILLUMINATED SIGN AND METHOD FOR DESIGN

(76) Inventors: Lance Mueller, R.R. 3, Box 103 K, Milton, DE (US) 19968; Patrick F Gleeson, 115 E. Evens Rd., Viola, DE (US) 19979

( * ) Notice: Subject to any disclaimer, the term of this patent is extended or adjusted under 35 U.S.C. 154(b) by 193 days.

(21) Appl. No.: 09/904,141

(22) Filed: Jul. 13, 2001

(65) Prior Publication Data

US 2001/0045034 A1 Nov. 29, 2001

Related U.S. Application Data

(60) Continuation-in-part of application No. 09/656,033, filed on Sep. 6, 2000, now Pat. No. 6,273,775, which is a division of application No. 09/199,851, filed on Nov. 25, 1998, now Pat. No. 6,199,310.

(60) Provisional application No. 60/067,445, filed on Dec. 4, 1997.

(51) Int. Cl.[7] ..... G09F 13/04

(52) U.S. Cl. ..... 445/22; 40/564; 362/812

(58) Field of Search ..... 445/22; 40/564; 362/812

(56) References Cited

U.S. PATENT DOCUMENTS

| | | | |
|---|---|---|---|
| 1,813,759 A | 7/1931 | Peters | |
| 2,046,044 A | 6/1936 | Vissing | |
| 2,057,064 A | 10/1936 | Shively et al. | |
| 2,080,679 A | 5/1937 | Vissing | |
| 2,090,989 A | 8/1937 | Van Deventer et al. | |
| 2,094,436 A | 9/1937 | Van Deventer et al. | |
| 2,118,385 A | 5/1938 | Shively | |
| 4,642,741 A | 2/1987 | Cohn | |
| 5,237,766 A | 8/1993 | Mikolay | |
| 5,253,151 A | 10/1993 | Mepham et al. | |
| 5,509,223 A | 4/1996 | Jung | |
| 5,533,286 A | 7/1996 | Fallon et al. | |
| 5,539,622 A | 7/1996 | Ishikawa | |
| 5,570,947 A | 11/1996 | Felland | |
| 5,966,856 A | 10/1999 | Alu | |
| 6,249,375 B1 * | 6/2001 | Silhengst et al. | 359/362 |
| 6,445,373 B1 * | 9/2002 | Yamamoto | 345/102 |

* cited by examiner

*Primary Examiner*—Dean A. Reichard
*Assistant Examiner*—Adolfo Nino

(57) ABSTRACT

An illuminated sign designed to be viewed from a horizontal line of sight of an observer, the sign comprising: a frame, a partially transparent face thereon, tubing mounted therein and having an inside radius (r), and a single or plurality of concavely-curved, reflective channels each being substantially semi-cylindrical and having a radius (R), and positioned at a distance (d) from the luminous tubing; wherein the improvement comprises each channel having an angle of wrap (β) approximately equal to about 70% to about 150% of the value that solves the equation $$\frac{1}{\sin\left(\frac{\beta}{2}\right)} + 2\left(\frac{R}{r} - \frac{d}{r} - 1\right)\cos\left(\frac{\beta}{2}\right) = \frac{R}{r}.$$

The method of designing such a sign comprises selecting the illuminated tubing with inside radius (r), determining the distance (d) between the tubing and the reflective channel, selecting the substantially semi-cylindrical reflective channel radius (R) and designing the angle of wrap (β) as defined above.

10 Claims, 3 Drawing Sheets

ILLUMINATED SIGN AND METHOD FOR DESIGN

CROSS-REFERENCE TO RELATED APPLICATION

This application is a continuation-in-part of U.S. application Ser. No. 09/656,033, filed Sep. 6, 2000 now U.S. Pat. No. 6,273,775 B1, incorporated herein by reference, which is a divisional application of U.S. application Ser. No. 09/199,851, filed Nov. 25, 1998, now U.S. Pat. No. 6,199,310 B1, which claims priority based on U.S. Provisional Application No. 60/067,445, filed Dec. 4, 1997.

TECHNICAL FIELD

This invention relates to an improved illuminated sign, and, more specifically to an improved sign and method for designing a sign that provides bright illumination without a visible presence of undesirable streaks in the illumined lettering or graphics of the sign.

BACKGROUND OF THE INVENTION

Illuminated signs are used throughout the world to convey information to passers-by. Neon is often chosen for such illuminated signs because of the distinctive, brilliant color and light it emits. Traditionally, neon has been used in the form where tubing is bent into the shape of a word. Manufacture of this type of sign requires the frequently costly services of a skilled glass tube bender. Such signs are also limited in that once they have been created (at considerable expense), they cannot be modified.

Referring now to FIGS. 1, 2, 8, and 9, there are depicted partial-cutaway plan views and cross-sectional side views of illuminated signs, known as grid signs or light-box signs. The general structure of such signs is known in the art. Grid signs are described generally in several early U.S. patents (for example, U.S. Pat. No. 1,813,759 to Thomas Peters, U.S. Pat. No. 2,080,679 to E. D. Vissing, U.S. Pat. No. 2,094,436 to H. R. VanDeventer et al., U.S. Pat. No. 2,046,044 to R. A. Vissing, and U.S. Pat. No. 2,118,385 to J. J. Shively). Such signs are not prevalent in commerce today. As shown in FIGS. 1 and 2, sign 10 comprises essentially a sign frame 14 having a width "W" in which are located lengthwise sections of luminous tubing 12 parallel to the width and providing illumination. The sign frame is covered by a sign face 18 having transparent letters 11 outlined by an opaque background 13.

FIGS. 8 and 9 show a light-box sign 50 with fluorescent bulbs 51 and a diffusion faceplate 52. Diffusion faceplate 52 has light diffusion properties and is spaced a sufficient distance from bulbs 51 to diffuse and distribute emitted and reflected light across the plate so the faceplate provides a relatively even light surface. The properties of this diffusion faceplate reduce significantly the amount of light (L2) that reaches the viewer as compared to the amount of light (L1) that is emitted by the bulb and therefore prevents the sign from achieving peak brightness. This loss of light (L1–L2) can be compensated for by increasing the light transmitting properties of the diffusion plate, which in turn typically results in streaks of greater and lesser brightness being more visible.

Luminous tubing 12 and 51 generally has a small diameter relative to the sign width. Therefore, to provide illumination over the complete sign width, numerous lengths of individual tubing are typically used in fluorescent light boxes. To achieve a similar effect with neon tubing, a single tube may be bent in alternating 180-degree curves into an S-shaped pattern with lengthwise sections 15 between curves 42, as shown in FIG. 1. The luminous tubing 12 is electrically attached to an electrical power supply 16. To provide a uniform appearance of light instead of a series of lines, the tubing may be mounted within curved, reflective channels 20 that have a mirrored surface.

A grid sign offers an advantage over signs comprising merely a neon tube bent into the shape of a word, in that a single sign frame 14 may be used with multiple or modifiable sign faces 18 to change the text of the sign as desired. The neon grid signs or fluorescent light boxes having diffusion plates which minimize the amount of light blocked, as described in the aforementioned references, have a disadvantage, however, in that from certain angles between the viewer and the sign, the light shining through the letters forms a streaked pattern, as depicted in FIG. 3. This streaked pattern may make the message on the sign difficult to read. Depending upon the quality of the reflectors behind the tubing, this streaked pattern may appear as a series of dark lines, or may comprise stripes of greater and lesser brightness.

The unilluminated ridges 22 between reflective channels 20 may contribute to the streaked pattern. A key factor in the creation of the streaked pattern is that the curvature of the reflector 20 may not reflect light back to the viewer 30 from the tubing 12 at certain viewing angles, as shown in FIG. 4, but instead reflects the lesser light coming from the direction of the viewer or other less lighted areas.

Some of the references disclosed above discuss ways to address this problem. Patent '679 describes the presence of metallic reflectors similar to reflectors 20 that reflect the light from the neon tubing in what is "practically a sheet of light". Patent '679 also describes, however, some presence of dark lines or reduced light reflection efficiency associated with each reflector embodiment. Significantly, patent '679 also refers to means for angling the sign to enable the sign to be more easily read when the observer is above or below the sign, implying that the illumination quality may suffer when the sign is at a vertical angle from the viewer.

Patent '436 purports to provide a sheet of neon "substantially free of the objectionable streaks and of uniform over-all brilliancy"; however, the reference provides no detail regarding the geometry of the reflectors, so that this claim can be verified. Additionally, the patent claims adjustable means for tilting the sign face at various angles, again suggesting that the sign may have required angular adjustment to facilitate streak-free viewing at certain angles.

The continued pursuit of an ultra-bright grid sign free of the undesirable streaked pattern in the 1930's and the dearth of such signs in commercial use today are testimony to the desirability and elusive nature of a sign that eliminates the streaked pattern. The present invention provides an illuminated light-box sign and method for designing such a sign that optimizes the dimensional properties of the reflector channels to eliminate or dramatically reduce the streaked pattern without a diffusion plate at all, or that allows the use of a diffusion plate having relatively high light transmission.

SUMMARY OF THE INVENTION

In accordance with this invention, there is provided an illuminated light-box sign with reflectors. The sign comprises a frame having a width, a partially transparent face supported thereon, a single or plurality of lengthwise sections of luminous tubing mounted in the frame, and a single or plurality of concavely-curved, reflective channels. The tubing has a tubing inside radius (r) and an inside surface having a reflector-closest edge. Each reflector has an angle of wrap (β) and a concave surface having a tubing-closest edge positioned at a distance (d) from the tubing inner surface reflector-closest edge. Each channel has a substantially semi-cylindrical shape with a radius of curvature (R). The improvement comprises each channel having an angle of wrap (β) of about 80% to about 150% of the value (β) that satisfies the following equation:

$$\frac{1}{\sin\left(\frac{\beta}{2}\right)} + 2\left(\frac{R}{r} - \frac{d}{r} - 1\right)\cos\left(\frac{\beta}{2}\right) = \frac{R}{r}.$$

The invention also comprises a method for designing an illuminated grid sign or light box having a single or plurality of lengthwise sections of light-emitting luminous tubing and a single or plurality of concavely-curved reflective channels, each positioned to reflect a portion of the light emitted by one of the lengthwise sections. The method comprises selecting a reflective channel radius (R) and the luminous tubing, the tubing having an inside radius (r) and an inner surface having a reflector-closest edge. Then, the distance (d) between the tubing inner surface reflector-closest edge and a tubing-closest edge of the reflective channel adjacent thereto is determined. Finally, the reflective channels are formed to be substantially semi-cylindrical with a radius (R) and angle of wrap (β) as described above.

The method preferably comprises selecting values for the luminous tubing inside radius (r), the distance (d), the reflective channel radius (R) and angle of wrap (β) that minimize visible streaks of brighter and less-bright illuminated regions in the sign.

DETAILED DESCRIPTION OF INVENTION

The invention will next be illustrated with reference to the figures wherein similar numbers indicate the same elements in all figures. Such figures are intended to be illustrative rather than limiting and are included herewith to facilitate the explanation of the apparatus of the present invention.

Figure 1:
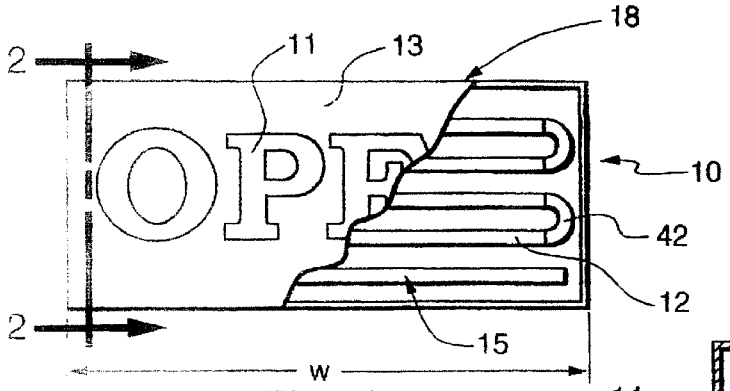
FIG. 1 is an illustration of a front view of a typical neon grid sign with a partial cutaway to show the luminous tubing behind the transparent face.
Figure 2:
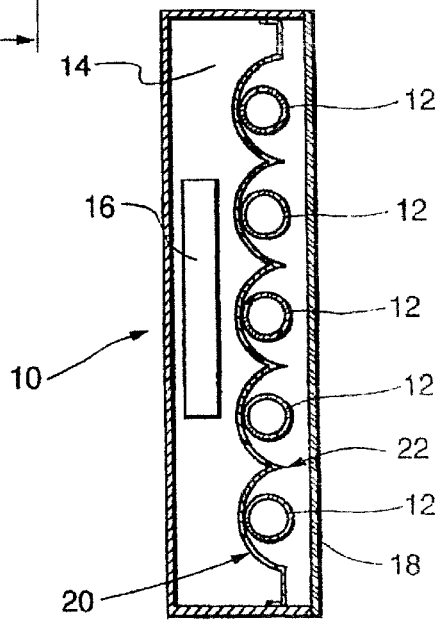
FIG. 2 is an illustration of a side view cross section of the neon grid sign of FIG. 1.
Figure 4:
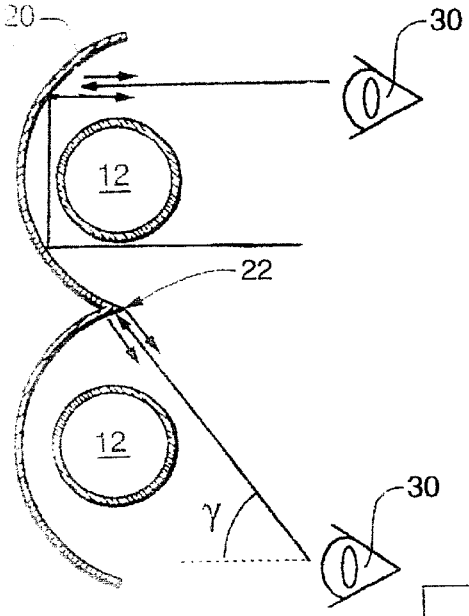
Fig. 4 (PRIOR ART)
FIG. 4 is an illustration of a side view cross section of a reflective channel of the prior art that allows a viewer to see reflections other than bright reflections in the reflective channel, thus creating the line effect.
Figure 6:
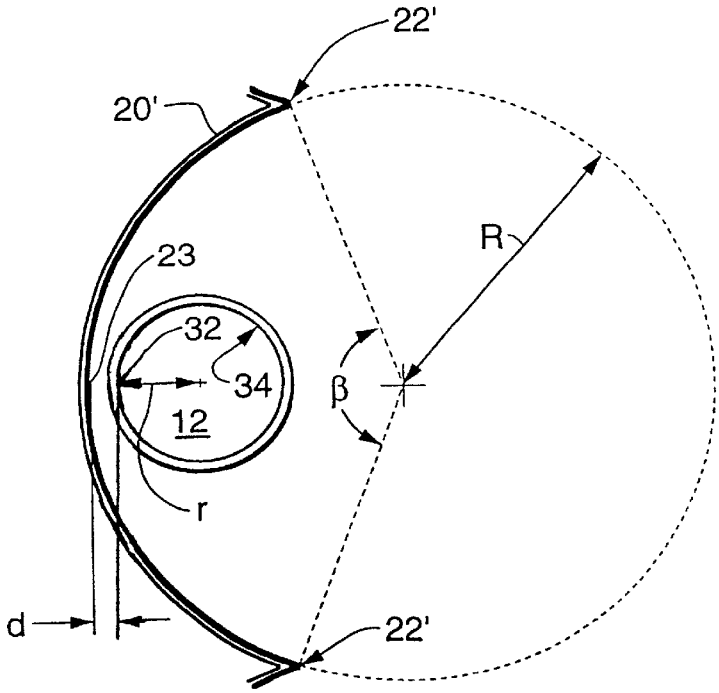
FIG. 6 is an illustration of a side view cross section of a reflective channel and luminous tubing therein, showing the critical relationships between components in accordance with the present invention.

Referring now to FIG. 6, there are shown the specific relationships among the various sign components according to the present invention with respect to the general configuration of a grid sign as shown in FIGS. 1 and 2. As used herein, "grid sign" typically refers to a sign with neon tubes, where as "light-box sign" typically refers to a sign that uses fluorescent tubes. The present invention pertains to both types of signs, however, and thus any reference to any particular type of sign does not limit the invention to that type.

In both the present invention and in the reference patents cited herein, a grid sign 10, as shown in FIGS. 1 and 2, generally comprises a frame 14 having a width (W), and a sign face 18 supported thereon and adapted to present display matter, shown here as transparent letters 11 on an opaque background 13. A plurality of lengthwise sections 15 of luminous tubing 12 is mounted therein, each section having a length parallel to the frame width (W), and each section mounted within a reflective channel 20.

As shown in FIG. 6, tubing 12 also has a reflector-closest edge 32 on tubing inner surface 34, and a tubing inner radius (r). The concavely-curved, substantially semi-cylindrical, reflective channels 20' intersect at ridges or cusps 22'. Reflector-closest edge 32 of the luminous tubing 12 is positioned at a distance (d) from the tubing-closest edge 23 of channel 20'. Distance (d) is measured from the tubing inside radius because this inside radius is coated with the luminescent coating that is the source of illumination.

It has now been determined that there is an unexpected relationship between reflective channel 20' radius (R), tubing 12 inner radius (r), the distance (d) of the tubing from the reflective channel, and the angle of wrap (β) that results in a sign that minimizes the undesirable streaked pattern. Reflective channels 20' according to the present invention have a substantially semi-cylindrical shape with an angle of wrap (β) that satisfies the following equation:

$$\frac{1}{\sin\left(\frac{\beta}{2}\right)} + 2\left(\frac{R}{r} - \frac{d}{r} - 1\right)\cos\left(\frac{\beta}{2}\right) = \frac{R}{r} \tag{1}$$

where:

R=the reflective channel radius of curvature r=the tubing inside radius

β=the angle of wrap d=the distance between the tubing inside radius and the reflective channel, as previously defined. "Substantially semi-cylindrical" as used in this specification and claims refers to a partial shell of a cylinder that may be half or less than half of a full cylinder, with a cross-section that is substantially circular. Conformance with this equation assures that reflective channels 20' reflect only the illuminated tubing 12 to the viewer, rather than additionally reflecting any generally less illuminated or unilluminated location. This reflection of any generally less illuminated or unilluminated region may cause the undesirable streaked pattern described.

The use of the above equation involves certain assumptions corresponding to the most common situations where a grid sign or light box may be used. For instance, referring to FIG. 5, it is assumed that the distance from the viewer 30' to the sign 10' is much greater than the radius of curvature (R)

of the reflective channels 20'. This assures that light coming from the viewer will be practically parallel upon striking the reflective channels, allowing reliable prediction of the light after reflection. Optical distortions such as spherical aberrations are ignored, but is accounted for by the permissible range of the angle of wrap β being outside of the exact value determined by equation.

The distance (d) between the luminous tubing 12 inside radius and the reflective channels 20' is often determined by the thickness of the tubing 12 wall and the allowed spacing used in the art. For a nominal T12 high output fluorescent bulb (Ex-F48T12CWHO) (tubing inside radius (r) of about 18.06 mm), and a radius of curvature (R) in the range of about 69.85 mm, the distance (d) can be typically about 3.57 mm.

Equation 1 may be used to calculate the optimum angle of wrap for any set of parameters. Although the equation defines a calculated optimum angle of wrap, in practice there is some flexibility in the choice of the actual angle of wrap, and the angle of wrap may be in a range of about 70% to about 150% of the value calculated by Equation 1. Preferably, the angle of wrap is in a range of 80% to 140%, and more preferably in a range of 90% to 130% of the value provided by Equation 1.

The ability to use a reflector with a greater angle than the calculated optimum angle is believed to be due in significant part to secondary reflections (reflections of light that bounce off the reflectors or reflectors and bulb multiple times). In practice, when secondary reflections are present they appear to increase the potentially usable angle of wrap (β) by up to approximately 25%. Although the light generated by these secondary reflections is of a lesser quality and brightness then the light provided by primary reflections, it still has a significant brightness that is worthwhile, especially if a diffusion plate is present. A second reason that the actual optimum angle of wrap may be greater than the calculated optimum value is because the refraction of light as it passes through the glass shell of the tubing somewhat increases the optimum value. A third reason that an actual optimum value greater than the calculated optimum value may be used, is the diffusing effect of sign face 18, diffusion plate 52, and any other diffusive sheet that may be placed in the path of the light. Light striking the sign face and/or diffusive sheet is partially redirected as a result of diffusion and reflection, helping to offset the reduced intensity of light coming from the region of cusps 22' between adjacent reflective channels. The use of a white plastic reflector, which scatters and diffuses light and reflects light less accurately than a mirrored reflector, also may have a significant impact on the actual angle chosen. It is believed that the increased volume of light or lighted surface area gained by extending β past the calculated optimum value offsets the increased tendency for darker regions near cusps 22' when diffusion is taken into account.

Because each bulb 12 is centered within a reflective channel 20', the angle of wrap can set the distance between bulbs. Also, preferably, the width of ridges or cusps 22' are no more than about 1/16" (1.6 mm), more preferably no more than about 1/32" (0.8 mm) wide, and more preferably as thin as possible, to minimize any contribution of the ridges to the aforementioned streaked pattern. Other methods for minimizing the contribution of ridges may also be employed, as are known in the art.

Thus, the invention also comprises a method for designing an illuminated grid sign or light box. The method comprises selecting the substantially semi-cylindrical reflective channels with a radius of curvature (R), selecting an illuminated tubing with an inside radius (r), and determining the distance (d) between the tubing inside radius and the reflective channel adjacent thereto. Finally, an angle of wrap (β) is chosen corresponding to about 70% to about 150% of the value of β that satisfies the equation provided herein. Preferably, the method comprises selecting values for r, d, R, and β that minimize visible streaks of brighter and less-brighter regions in the sign.

Figure 7:
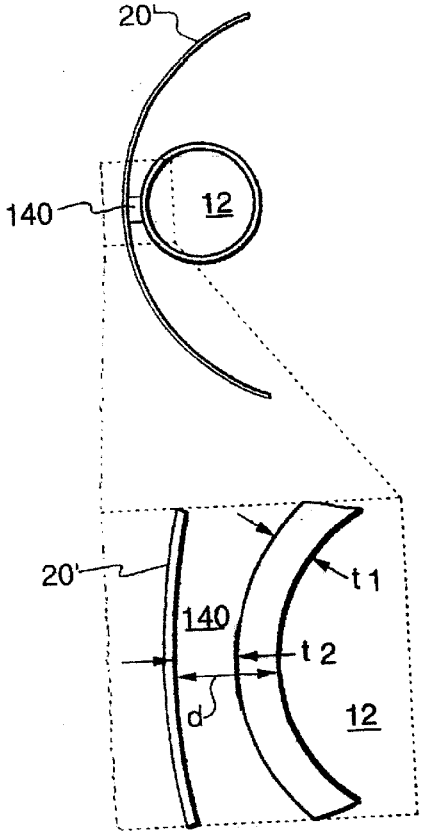
FIG. 7 is an illustration of a side view cross section of a reflective channel embodiment having a space behind the luminous tubing.
Figure 9:
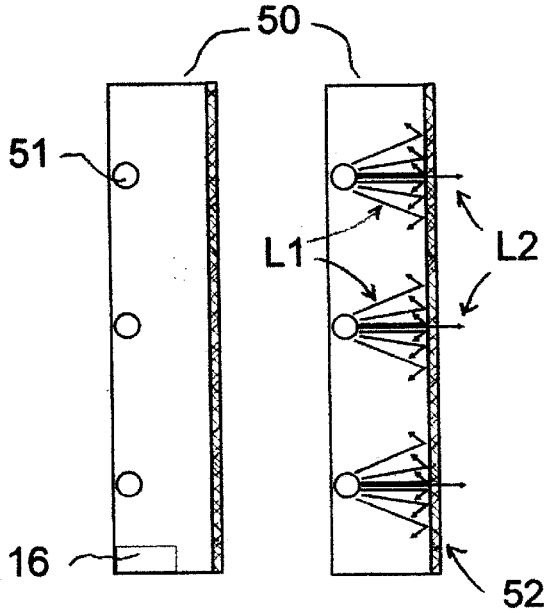
FIG. 9 is an illustration of a side view cross section of the light box of FIG. 8.

The reflective channels 20' may comprise a contiguous mirrored surface, may comprise a white plastic or glossy white plastic. Preferably, tubing 12' may be offset a specified distance from reflector 20' by distance d as shown in FIGS. 6 and 7. The parent application on which this continuation-in-part is based discloses several alternate embodiments of reflective channels having various other means of preventing luminous tubing 12' from conducting secondary electrical current leakage to the reflector. In one embodiment, reflective channel 20' may comprise a metalized reflective film, such as chrome or metalized polyester, adhered to a non-conductive reflector support surface, such as polyvinylchloride (PVC) or ABS plastic. In another embodiment, a dielectric layer may be located between luminous tubing 12' and reflector 20'.

Figure 8:
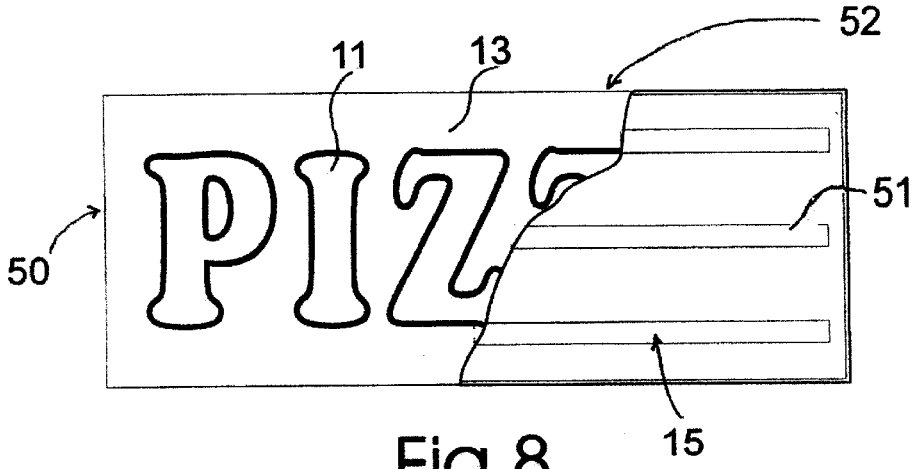
FIG. 8 is an illustration of a front view of a typical light box with a partial cutaway to show the luminous fluorescent tubing behind the translucent face or diffusion plate.

The luminous tubing may comprise a single neon tube 12 repeatedly bent in alternating 180-degree curves 42 to create lengthwise sections 15 between the curves as shown in FIG. 1. As shown in FIG. 8, in an alternate exemplary embodiment, plurality of lengthwise sections 15 may comprise a plurality of separate parallel neon or fluorescent or other tubes 51.

The sign frame 14, sign face 18, power supply 16 (which may comprise a transformer or "ballast"), fluorescent bulbs, and associated wiring, as well as the bent luminous tubing 12, where present, may be constructed and assembled by any methods known in the art. The sign frame may comprise metal such as aluminum or a lightweight material such as plastic. Furthermore, manufacture of prototypical and commercial units in conformance with the present invention may require slight deviation from the optimum dimensions predicted by the above equations, for conformance with standard components available in the industry or to satisfy other production considerations.

Although at times described herein with respect to luminous fluorescent or neon tubing, the present invention is equally applicable to illuminated grid signs using other forms of luminous tubing.

Figure 5:
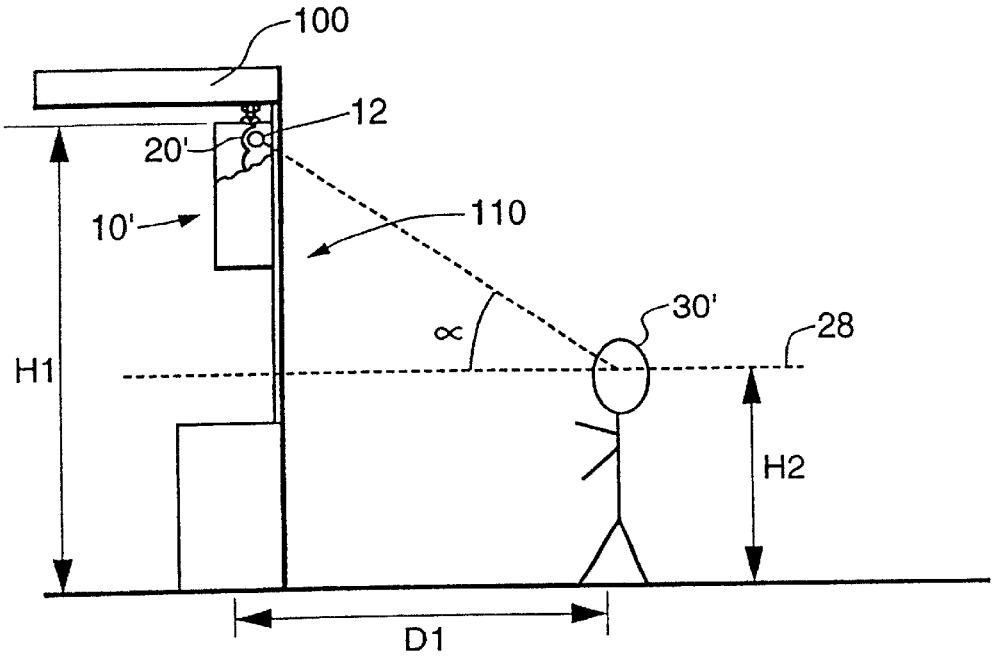
FIG. 5 is an illustration of a side view of a sign in cutaway cross-section and a viewer, showing distances that determine a maximum viewing angle.

The angle of wrap in accordance with this invention may be used in conjunction with the overall reflector design described in more detail in U.S. patent application Ser. No. 09/656,033, incorporated herein by reference. Thus, reflective channels 20' may have a substantially semi-cylindrical shape with a radius of curvature (R) consistent with the following equation:

$$R=r\times(1+1/(\sin\alpha))+d \qquad (2)$$

where:

R=the reflective channel radius of curvature;

r=the tubing inside radius;

α=the maximum viewing angle (arctan((H1−H2)/D1)) as illustrated in FIG. 5; and d=the distance between the tubing inside radius and the reflective channel.

The actual radius (R) may be less than 120%, preferably within 80–120% of the result given by Equation 2, and more preferably approximately equal to the result given by Equation 2.

EXAMPLE

The following example is included to more clearly demonstrate the overall nature of the invention, referring to FIGS. 5–9 for the enumerated components. This example is exemplary, not restrictive, of the invention.

A prototype illuminated grid sign light box 50, which was 20 inches tall by 32½-inches wide, was designed. The sign was constructed using industry-standard nominal F30T12CWHO fluorescent bulbs 51 having an actual inside diameter of about 36.12 mm (r=18.06 mm) and a reflective channel diameter of 139.7 mm (R=69.85 mm). The distance (d) between the tubing (12) inside radius and the reflector (120) was approximately 3.57 mm, corresponding to about the thickness ($t_1$) of the tubing 12 wall plus the thickness ($t_2$) of the space between the reflector and the outside radius of the tubing, as shown in FIG. 7.

The reflective channels were constructed of white, formed plastic (PVC) sheet with a chrome polyester mirror finish to provide the reflective surface, with an angle of wrap (β)=125 degrees. For R=69.85 mm (139.7 diameter), r=18.06 mm, and d=3.57 mm, the value for β which solves Equation 1 is approximately 119°, which is about 5% less than the 125° value that was actually chosen (or conversely, the actual value is about 5% greater than the calculated value).

Figure 3:
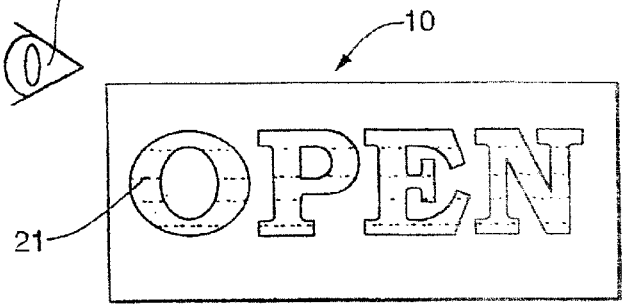
Fig. 3 (PRIOR ART)
FIG. 3 is an illustration of a front view of a neon grid sign of the prior art, depicting the undesirable streaked pattern visible to a viewer at certain angles.

The sign was viewed and the aforementioned streaked pattern, as depicted in FIG. 3 of the prior art, was not present. When viewed from an angle perpendicular to the face of the sign (which is a critical angle for determining angle of wrap), two distinct regions of reflections were observed: a region containing "primary" reflections and a region containing "secondary" reflections. The region containing "primary" reflections was full and bright throughout the angle of wrap in the 119° predicted by the equation. Outside of the 119° angle, "secondary" reflections were observed. The region containing the secondary reflections contained a mix of both lighted and less lighted areas. The "secondary" reflections did not appear to be as bright as the "primary" reflections and appeared to comprise light that had been reflected multiple times. To the naked eye, these secondary reflections appear to be approximately 30 to 95% as bright as the primary reflections. Secondary reflections will or will not appear depending on the chosen combinations of R, r and d. When secondary reflections do appear then can generally add up to another 25% additional lighted area to the angle of wrap.

Preferably, an angle of wrap greater than the angle predicted by the equation is used only when a non-mirrored white reflector is used or a diffusion plate is used, as shown in FIG. 8. If a diffusion plate 52 with sufficient light diffusion properties is used and the diffusion plate is situated a proper distance from bulb 51, the area outside the predicted angle of wrap that is illuminated by secondary reflections is illuminated sufficiently to be acceptable. The diffusion plate adequately diffuses the light so that light L2 does not show any streaks caused by the less lighted areas within the secondary reflections. The overall benefit to extending the actual angle of wrap beyond the calculated value is the increase in the surface area of the sign. In general, because the reflector design of the present invention provides a plane of light at the diffusion plate that is already nearly streak-free, a diffusion plate may be omitted or may be used having a far greater light transmittance than those typically used in the prior art.

The ability to use no diffusion plate or diffusion plates with increased transmittance as compared to the prior art may provide a number of advantages. For example, the overall brightness of the illumination provided by a light box of this invention for a given energy input may be greater than a standard light boxes known in the art for the same energy input. This ability to get more illumination to the viewer of the sign may be used to achieve extraordinary brightness that rivals neon lighting in quality. Instead, however, the ability to get more illumination with less power, may also allow the use of cheaper, lower-output bulbs to produce the same effect as standard light boxes. The improved reflector design may allow the use of cheaper, white plastic as a material of construction instead of more expensive metallized plastic. The improved design may also allow for a thinner overall cross-section of the sign, making it less bulky.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. An illuminated sign designed to be viewed from a horizontal line of sight of an observer, the light box comprising:

a frame having a width;

a partially transparent face supported thereon;

a single or plurality of lengthwise sections of luminous tubing mounted in the frame and having a tubing inside radius (r) and an inner surface having a reflector-closest edge, and;

a single or plurality of concavely-curved, reflective channels each having an angle of wrap (β) and a concave surface having a tubing-closest edge positioned at a distance (d) from the tubing inner surface reflector-closest edge;

a reflective channel having a substantially semi-cylindrical shape with a radius of curvature (R)

wherein the improvement comprises each said reflective channel having an actual angle of wrap (βa) approximately equal to about 70% to about 150% of a calculated value for βc which solves an equation consisting of:

$$\frac{1}{\sin\left(\frac{\beta c}{2}\right)} + 2\left(\frac{R}{r} - \frac{d}{r} - 1\right)\cos\left(\frac{\beta c}{2}\right) = \frac{R}{r}.$$

2. The illuminated sign of claim 1 wherein the actual angle of wrap (βa) is approximately equal to about 80% to about 140% of the value βc.

3. The illuminated sign of claim 1 wherein the actual angle of wrap (βa) is approximately equal to about 90% to about 130% of the value βc.

4. The method of claim 3 comprising selecting values for the luminous tubing inside radius (r), the distance (d), the reflective channel radius (R) and angle of wrap (β) that minimize visible streaks of brighter and less-bright illuminated regions in the sign.

5. The illuminated sign of claim 1 wherein the plurality of lengthwise sections of luminous tubing comprise a plurality of parallel neon or fluorescent tubes.

6. The illuminated sign of claim 1 wherein the light box is further designed to be viewed at a maximum viewing angle (α) from a horizontal line of sight of an observer and the radius of curvature (R) is approximately equal to about 80% to about 120% of $r\times(1+1/(\sin\alpha))+d$.

7. The illuminated sign of claim 1 wherein the frame comprises a material selected from a group consisting of: aluminum, a non-aluminum metal, and plastic.

8. The illuminated sign of claim 1 further comprising a diffusion plate mounted to the frame or to the partially transparent face.

9. A method for designing an illuminated sign having a plurality of lengthwise sections of light-emitting luminous tubing and a plurality of concavely-curved reflective channels having a substantially semi-cylindrical shape with a radius of curvature (R), each channel positioned to reflect a portion of the light emitted by one of said lengthwise sections, the method comprising the steps of:

(a) selecting the luminous tubing, said tubing having an inside radius (r) and an inner surface having a reflector-closest edge;

(b) selecting a distance (d) between the tubing inner surface reflector-closest edge and a tubing-closest edge of the reflective channel adjacent thereto;

(c) forming the reflective channels to be substantially semi-cylindrical in shape with actual angle of wrap (βa) approximately equal to about 70% to about 150% of a value for βc which solves an equation consisting of:

$$\frac{1}{\sin\left(\frac{\beta c}{2}\right)} + 2\left(\frac{R}{r} - \frac{d}{r} - 1\right)\cos\left(\frac{\beta c}{2}\right) = \frac{R}{r}.$$

10. The method of claim 8 further comprising determining a maximum viewing angle (α) from which an observer will view the sign, measured from a horizontal line of sight, and in step (c), forming the channels to have a radius (R) approximately equal to about 80% to about 120% of r×(1+1/(sin α))+d.

* * * * *